US008959779B2

(12) United States Patent
Wen

(10) Patent No.: US 8,959,779 B2
(45) Date of Patent: Feb. 24, 2015

(54) MULTI-ANGLE POSITIONED FOLDABLE KNIFE

(75) Inventor: Hao Wen, Shanghai (CN)

(73) Assignee: Kunjek Handtools & Hardware Co., Ltd., Shanghai (CN)

( * ) Notice: Subject to any disclaimer, the term of this patent is extended or adjusted under 35 U.S.C. 154(b) by 108 days.

(21) Appl. No.: 13/516,671

(22) PCT Filed: Sep. 26, 2010

(86) PCT No.: PCT/CN2010/001484
§ 371 (c)(1),
(2), (4) Date: Sep. 27, 2012

(87) PCT Pub. No.: WO2011/140690
PCT Pub. Date: Nov. 17, 2011

(65) Prior Publication Data

US 2013/0042485 A1 Feb. 21, 2013

(30) Foreign Application Priority Data

May 10, 2010 (CN) ..... 2010 2 0188248 U

(51) Int. Cl.
*F41C 27/18* (2006.01)
*F41B 13/02* (2006.01)
(Continued)

(52) U.S. Cl.
CPC ..... *B26B 1/046* (2013.01)
USPC ..... 30/161; 30/155; 30/160; 30/337

(58) Field of Classification Search
USPC ..... 30/160, 161, 162, 153–159, 337; 81/60, 81/63, 177.8, 177.9, 177.6; 15/236.01; 16/324–326; D8/99
See application file for complete search history.

(56) References Cited

U.S. PATENT DOCUMENTS 3,930,309 A 1/1976 Collins
5,327,651 A * 7/1994 Favreau ..... 30/161
(Continued)

FOREIGN PATENT DOCUMENTS

CN 87210703 U 6/1988
CN 2695190 Y 4/2005
(Continued)

OTHER PUBLICATIONS

International search report and written opinion for application No. PCT/CN2010/001484 dated Feb. 24, 2011.

*Primary Examiner* — Boyer D Ashley
*Assistant Examiner* — Richard Crosby, Jr.
(74) *Attorney, Agent, or Firm* — Patterson & Sheridan LLP

(57) ABSTRACT

A multi-angle positioned foldable knife includes a knife body (1), a handle (2) and a pin (3). The knife body (1) is pivotally connected with the handle (2) through the pin (3). A cam (4) is arranged on the connecting end of the knife body (1), and snap openings (41) on the outer edge of the cam are provided to position the knife body (1) at multi-angle relative to the handle (2). A positioning button (5) is arranged on the connecting end of the handle (2), and a snap edge (51) is provided on the interior end of the button (5). The snap edge (51) can connect with a snap opening (41) on the outer edge of the cam (4). Compared with prior art, the foldable knife has simple structure, controlled angle, safe use, convenient operation, simple preparation etc. The knife body (1) can be positioned at multi foldable position. Additionally, the rotation of the knife body (1) can be achieved only by pressing the button (5).

12 Claims, 6 Drawing Sheets

(51) Int. Cl.
*B26B 3/06* (2006.01)
*B26B 1/04* (2006.01)

(56) References Cited

U.S. PATENT DOCUMENTS

| | | | | |
|---|---|---|---|---|
| 5,722,168 | A | 3/1998 | Huang | |
| 6,446,341 | B1 * | 9/2002 | Wang et al. | 30/125 |
| 6,711,820 | B2 * | 3/2004 | Chen | 30/122 |
| 7,000,323 | B1 * | 2/2006 | Hatcher et al. | 30/155 |
| 8,215,021 | B2 * | 7/2012 | Seber et al. | 30/161 |
| 2006/0168818 | A1 * | 8/2006 | Outen | 30/161 |
| 2009/0056146 | A1 * | 3/2009 | Duey | 30/159 |
| 2009/0277015 | A1 * | 11/2009 | Duey | 30/160 |
| 2012/0023753 | A1 * | 2/2012 | Wen | 30/156 |
| 2012/0192382 | A1 * | 8/2012 | Honsberger et al. | 16/401 |

FOREIGN PATENT DOCUMENTS

| | | | |
|---|---|---|---|
| CN | 270006 | Y | 5/2005 |
| CN | 1683124 | A | 10/2005 |
| CN | 201357417 | Y | 12/2009 |
| CN | 201405359 | Y | 2/2010 |

* cited by examiner

MULTI-ANGLE POSITIONED FOLDABLE KNIFE

FIELD OF THE INVENTION

Embodiments of the present invention generally relate to a folding knife. More particularly, embodiments of the present invention relate to a folding knife with multiple locking angles.

DESCRIPTION OF THE RELATED ART

Current folding knives generally include a knife handle having a blade storage slot, a shaft secured in the blade storage slot in one end of the knife handle, and a knife body pivoting about the shaft. A resilient liner may be disposed in the blade storage slot in a position opposite to a tang of the knife body or a resilient back hook may be disposed in a back of the knife handle. When the folding knife is open and unfolded, the resilient liner pushes against a groove in the tang of the knife body or a protruding hook of the back hook inserts into the groove in the tang of the knife body to lock and prevent the knife body from pivoting or folding.

The current folding knives have defects. The current folding knives can only be locked in one position when unfolded. The current folding knives cannot be locked at multiple positions when unfolded or be locked at the folded position. To release the current folding knives from the locked unfolded position, the resilient liner facing the blade needs to be pressed manually. Therefore, the current folding knives may cause injuries to hand, thus not safe to use. On the hand, to press a pole of the back hook, it is necessary to change the hand position from normal knife use position, thus, it is not convenient.

The Chinese Patent No. ZL200420065559.4 discloses a folding knife having a safety switch. The folding knife includes an upper handle, a lower handle, an upper separating sheet and a lower separating sheet having corresponding elongated holes. A safety switch is retained in the elongated holes. The safety switch includes a blocking post, a locking pin, a spring, and a push button. The locking pin is disposed in a through hole along a radial direction of the blocking post. A horizontal slot is formed in the elongated holes to retain the locking pin. One end of the spring is coupled to the blocking post while another end of the spring is secured to a screw. By pushing the push button, a user can push the blocking post along the elongated holes, thus release the blocking post a locked position in a locking notch on the back of the knife blade. On the other hand, when the knife blade is unfolded to the maximal angle, the spring biases the blocking post towards the locking notch on the knife blade, thus increasing safety. Even though the locking notch of the knife blade may be secured by the blocking post preventing the knife blade from injuring user during unfolding and improve safety, the folding knife is structurally complex and has a high production cost. Additionally, the folding knife cannot be locked at multiple angles, thus, inconvenient for use.

The Chinese Patent No. ZL200920052303.2 discloses a safety mechanism for a folding knife. A sliding block is disposed in a handle of the folding knife. A front end of the sliding block and a tail end of a knife blade are locked together. A resilient reset element is positioned between a back end of the sliding block and the handle. When the knife blade is at an open and unfolded position, a user can push the sliding block backwards to release the knife blade from the locked position to fold the knife blade. When opening the knife blade to the opening position, the sliding block resets to its original position under the bias of the resilient rest element, thus relock the knife blade. Even though the safety mechanism can lock the knife blade at the open and closed positions, the safety mechanism cannot lock the knife blade at other positions in between. During pivoting, the knife blade may cause injuries.

The Chinese Patent No. ZL200920056935.6 discloses a multi-function folding knife having a knife body and a knife handle. The knife handle includes an upper handle plate, a lower handle plate, and a middle handle plate. The upper handle plate, lower handle plate and middle handle plate fixedly coupled to handle ends forming a knife slot. The knife body is riveted to one end of the knife handle and positioned within the knife slot of the knife handle. The knife handle and the riveted end of the knife body form a structure of a vise. The structure of this folding knife is relatively simple. Even though the folding knife can function as a folding knife and a vise, the knife blade faces the user's hand during operation and may cause injuries, therefore, is not very safe.

SUMMARY OF THE INVENTION

Aimed to cure the above defects in current folding knives, embodiments of the present invention provide a folding knife having multiple locking angles which allows angle control, is safe to use and simple to manufacture.

One embodiment of the present invention provides a folding knife having multiple locking angles. The folding knife includes a knife handle and a knife body. The knife handle is pivotably coupled to a first end of the knife body. The folding knife further includes an angle adjusting mechanism fixedly coupled to the first end of the knife body. The angle adjusting mechanism comprises a plurality of locking structures configured to position the knife body and the knife handle at different angles. Each locking structure has at least one notch opening. A first locking edge of the notch opening is smaller than a second locking edge of the notch opening. The folding knife further includes a positioning mechanism configured to select an angle between the knife body and the knife handle. When the knife body and the knife handle is locked at an angle, the positioning mechanism is couple to and lock with the second locking edge of a corresponding notch opening. A lateral distance moved by the positioning mechanism is related to a radial length of the second locking edge.

The positioning mechanism includes a push button. The push button includes a push button unit, a locking edge, and a recess ring having one end connected to the push button unit and another end connected to the locking edge. When the push button unit is pressed down, the locking edge moves out of the notch opening to allow the knife body obtain a new angle relative to the knife handle. When the push button unit is released, the locking edge enters and locks with the second locking edge of the notch openings.

A lateral distance between a position of the push button unit being pressed down and a position of the push button unit being released is slightly larger than a axial length of the second locking edge of the notch opening.

The second locking edge of the notch opening transits to the first locking edge of the notch opening along a smooth curve. Alternatively, the second locking edge of the notch opening transits to the first locking edge of the notch opening along a stepped line.

The angle adjusting mechanism includes a cam. The plurality of locking structures are distributed along an outer edge of the cam. The plurality of notch openings are evenly distributed along the outer edge of the cam, and each notch opening is a half cylinder shaped groove.

Another embodiment of the present invention provides a folding knife having multiple locking angles. The folding knife includes a knife handle and a knife body. The knife handle is pivotably coupled to a first end of the knife body. The folding knife further includes an angle adjusting mechanism fixedly coupled to the first end of the knife body. The angle adjusting mechanism comprises a plurality of locking structures configured to position the knife body and the knife handle at different angles. The folding knife further includes a positioning mechanism configured to select an angle between the knife body and the knife handle. When the knife body and the knife handle is locked at an angle, the positioning mechanism is couple to and lock with one of the plurality of locking structures.

The angle adjusting mechanism includes a cam. The plurality of locking structures are distributed along an outer edge of the cam.

The plurality of notch openings are evenly distributed along the outer edge of the cam, and each notch opening is a half cylinder shaped groove.

The positioning mechanism includes a push button. The push button includes a push button unit, a locking edge, and a recess ring having one end connected to the push button unit and another end connected to the locking edge. When the push button unit is pressed down, the locking edge moves out of the notch opening to allow the knife body obtain a new angle relative to the knife handle. When the push button unit is released, the locking edge enters and locks with the second locking edge of the notch openings.

Compared to the current technology, embodiments of the present invention have the following advantages:

First, by using the structure of notch openings and a positioning push button, the knife body may be locked at multiple folding positions and the locking angle may be controlled, thus preventing injuries caused by unintentional unfolding. Additionally, the design of the notch opening not only allows the locking edge to be locked in the notch opening, but also limits the lateral distance along which the position push button can travel. The structure is simple and convenient to use.

Second, the knife body may be rotated by pressing the positioning push button only, thus avoiding the risks to hands caused by facing the knife blade directly and improving safety.

Furthermore, embodiments of the present invention use a very simple structure to provide a push button folding knife with multiple locking angles. The design is easy to manufacture.

DETAILED DESCRIPTION

Embodiments of the present invention are described in detail in association with the figures and examples.

EXAMPLE 1

Figure 1:
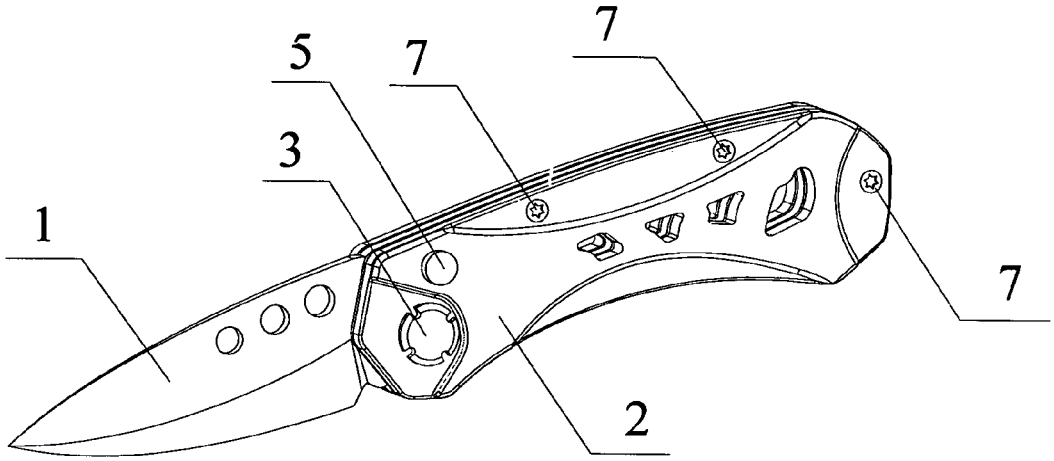
FIG. 1 is a schematic perspective view of a folding knife according to one embodiment of the present invention.
Figure 2:
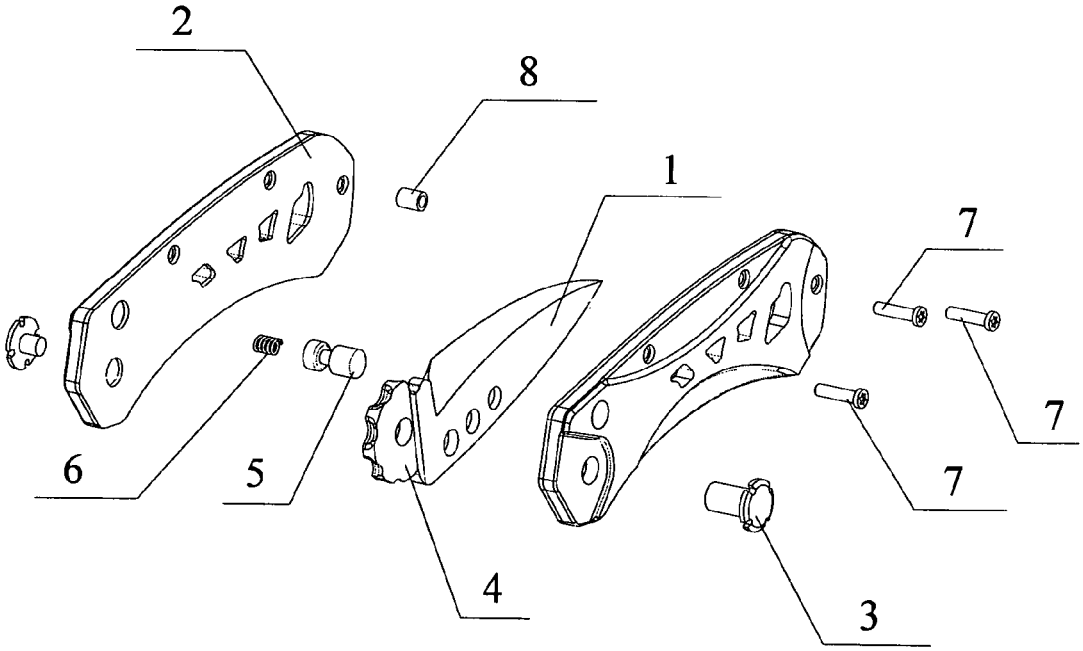
FIG. 2 is an exploded perspective view showing a knife body is folded in a knife handle.
Figure 3:
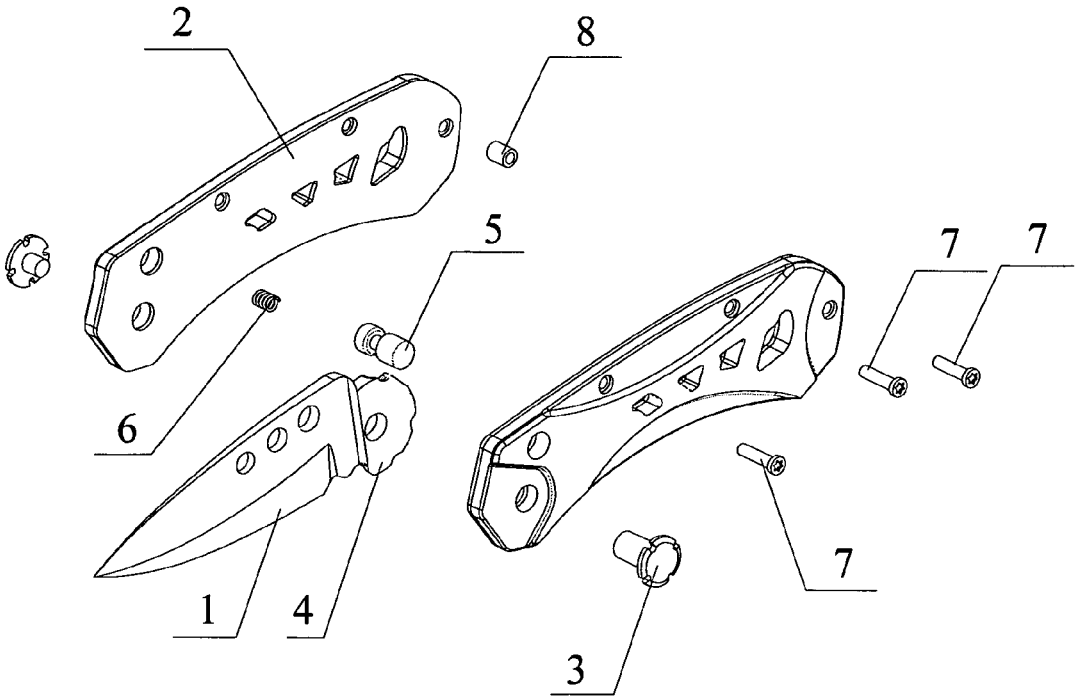
FIG. 3 is an exploded perspective view showing the folding knife in an opened position.

As shown in FIGS. 1-3, a folding knife with multiple locking angles includes a knife handle 2, a knife body 1 pivotably coupled to the knife handle 2 at a first end 11, an angle adjusting mechanism, and a positioning mechanism.

The angle adjusting mechanism is fixedly disposed on the first end 11 of the knife body 1 and includes a plurality of locking structures configured to position the knife body 1 and the knife handle 2 at different angles. Each locking structure has at least one notch opening. The angle adjusting mechanism may have various forms. In the present embodiment, the angle adjusting mechanism is a cam 4. The angle adjusting mechanism may also be in the form of a circular plate having a plurality of circular holes functioning as notch openings. That is to say, the angle adjusting mechanism is not limited to the structure shown in the figures, other structures are contemplated.

The positioning mechanism is configured to select an angle between the knife body 1 and the knife handle 2. When an angle between the knife body 1 and the knife handle 2 is selected, the positioning mechanism couples to a notch opening. The positioning mechanism may be in the form of but not limited to a push button.

When the positioning mechanism is coupled to a notch opening, the knife body 1 and the knife handle 2 form a fixed angle. The number of notch openings determines the number of fixed angles between the knife body 1 and the knife handle 2. The location of each notch opening on the angle adjusting mechanism directly determines the degree of the corresponding angle between the knife body 1 and the knife handle 2. Therefore, embodiments of the present invention may use predetermined degrees of angles between the knife body 1 and the knife handle 2 and the number of the angles to determine the number of notch openings and the corresponding location of each notch opening on the angle adjusting mechanism.

An embodiment includes a positioning mechanism in the form of a push button and an angle adjusting mechanism in the form of a protruding edge is described below in detail.

Figure 4:
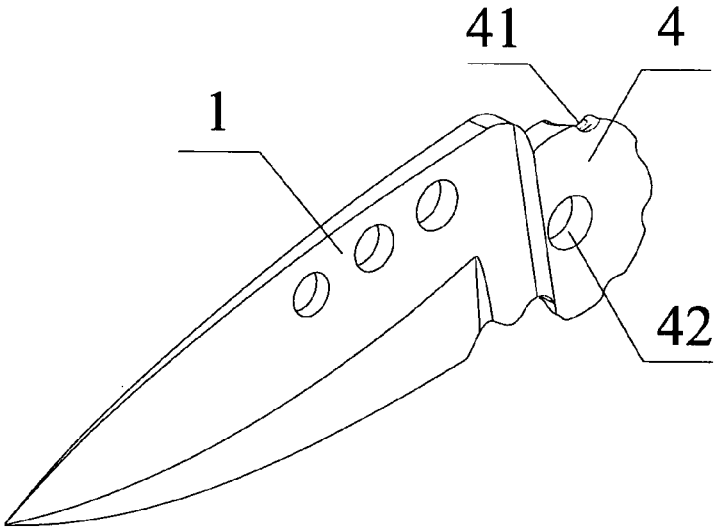
FIG. 4 is an enlarged view of the knife body.
Figure 5:
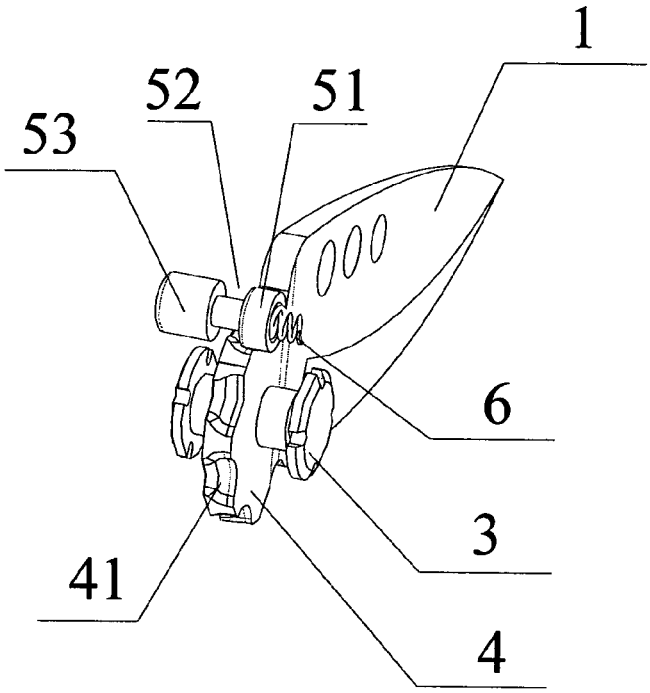
FIG. 5 is an enlarged view showing a cam.

The folding knife includes the knife body 1, the knife handle 2, a shaft pin 3, a cam 4, and a positioning push button 5. As shown in FIG. 4, the knife body 1 and the cam 4 are formed in a unitary body with the cam 4 disposed at an end of the knife body 1. As illustrated in FIG. 5, the cam 4 has a plurality of notch openings 41 evenly disposed along an outer edge. The plurality of notch openings 41 are configured to enable multiple locking angles between the knife body 1 and the knife handle 2. First, locations of the plurality of notch openings on the outer edge of the cam 3 and the number of the notch openings may be determined according to the requirements of the folding knife. When the folding knife requires a relatively large number of locking angles, a relatively large number of notch openings 41 may be provided. The degrees of the locking angles of the folding knife may be used to calculate corresponding locations of the notch openings 41. In the present embodiment, the plurality of notch openings 41 are evenly distributed along the outer edge of the cam 4. However, embodiments of the present invention are not limited to this configuration. Furthermore, the number of the plurality of notch openings 41 may be 3, 4, 5, 6, or other suitable number.

In the present embodiment, each of the plurality of notch openings 41 is a groove in the shape of a half cylinder. The positioning push button 5 includes a locking edge 51, a recess ring 52, and a push button unit 53. The shape of the grooves in the notch openings 41 corresponds to the locking edge 51 and the recess ring 52. The only requirement for the grooves are to couple to and lock with the locking edge 51 and to rotate along the recess ring 52. In other words, the grooves of the notch openings are not limited to be in the shape of a half cylinder.

When the push button unit 53 is pressed down, the locking edge 51 moves out of the notch opening 41, and the knife body 1 may obtain a new angle relative to the knife handle. When the push button unit 53 is released, the locking edge 51 enters and locks with one of the plurality of notch openings 41.

Figure 7A:
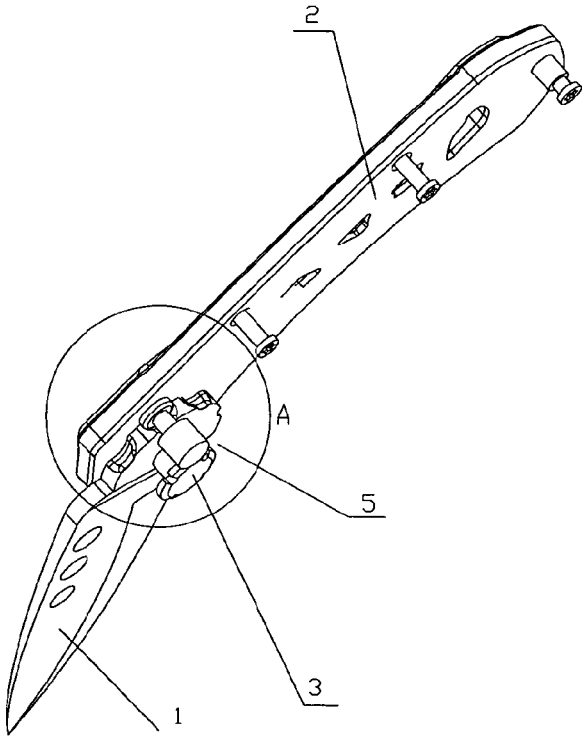
FIG. 7A is a perspective view of a second structure according to embodiment of the present invention.
Figure 7B:
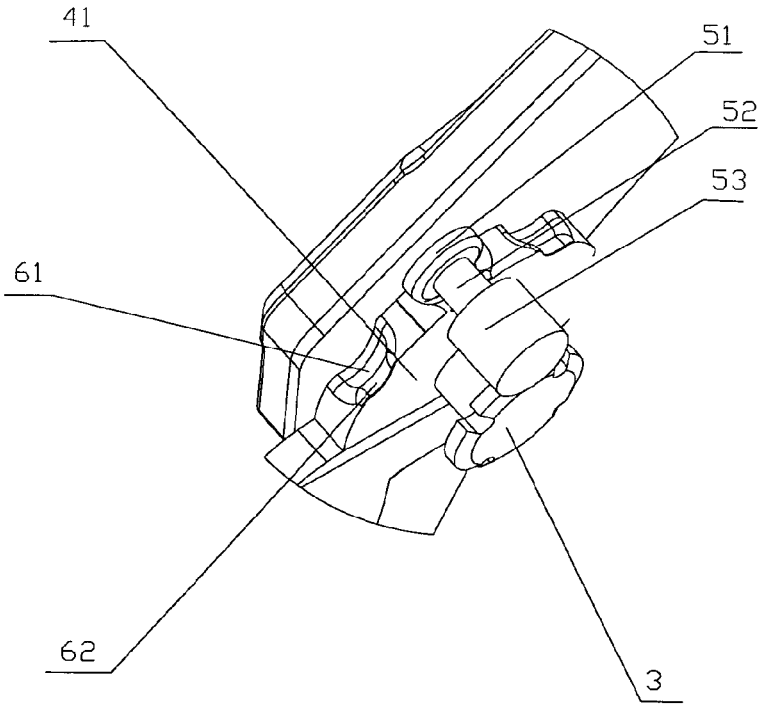
FIG. 7B is an enlarged view of portion A of the second structure.

Referring to FIGS. 5 and 7A-7B, each notch opening 41 may include a first locking edge 62 and a second locking edge 61. A diameter of the first locking edge 62 is smaller than a diameter of the second locking edge 61 thus forcing the locking edge 51 to couple to and lock with the second locking edge 61 of each notch opening 41 and limiting the distance of lateral movement of the positioning push button 5. When the push button unit 53 is pressed down, the locking edge 51 is moved out of the second locking edge 61of the notch opening 41. When the push button unit 53 is released, the locking edge 51 is coupled to and locked in the second locking edge 61 of one of the notch openings 41. Therefore, the lateral distance moved by the push button unit 53 between a position of being pressed down and a position of being released is slightly larger than a radial length of the second locking edge 61. In general, the summation of the distance between the cam 4 and the knife handle 2 and the radial length of the second locking edge 61 is equal to the lateral distance moved by the push button unit 53 between the position of being pressed down and the position of being released.

The inner diameter of the notch opening 41 may increase gradually in steps from the first locking edge 62 to the second locking edge 61. An outer surface of the locking edge 51 may also have a corresponding shape of steps. The inner diameter of the notch opening 41 may also increase gradually along a smooth curve from the first locking edge 62 to the second locking edge 61 and the outer surface of the locking edge 51 may also have a corresponding smooth curve. The axial length of the second locking edge 61 may be ¼ to ⅔ of a axial of the entire notch opening 41. Embodiments of the present invention are not limited to the above example.

In the present embodiment, a through hole 42 is formed in a middle portion of the cam 4. The through hole 42 allows the knife body 1 to pivot about the shaft pin 3. This is only one example of movably coupling the knife body 1 to the knife handle 2. In fact, alternatively, a string perforation, different than the through hole 42, may be formed in the knife body 1 to allow the shaft pin 3 to pass through the string perforation and to enable the knife body 1 to be movably coupled to the knife handle 2 through the shaft pin 3 and to enable the knife body 1 to rotate about the shaft pin 3.

Figure 6:
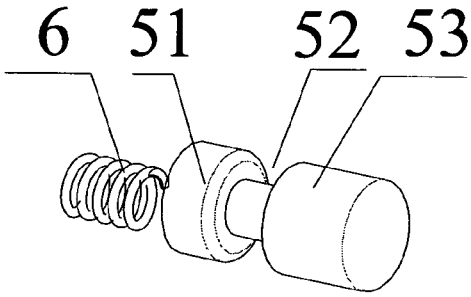
FIG. 6 is an enlarged view showing a positioning button.

The knife handle 2 includes two handle shells connected by screws 7. A threaded sleeve is disposed over the screw 7 positioned at a back end of the knife handle 2. A gap is present between the two handle shells. The knife body 1 and the cam 4 are disposed in the gap between the two handle shells. The pressable positioning push button 5 is positioned in a front end of the knife handle 2. The positioning push button 5 is illustrated in FIG. 6. The positioning push button 5 has a shape of a dumb bell having the locking edge 51, the recess ring 52 and the push button unit 53. A reset spring 6 is coupled to a back end of the positioning push button 5 to bias the positioning push button 5 to an original position. The rest spring 6 is coupled between the positioning push button 5 and the handle shell. The locking edge 51 positioned in an inner end of the positioning push button 5 is coupled to a notch opening 41 on the outer edge of the cam 4. Additionally, the knife handle 2 has a through hole (not shown) formed in a location corresponding to the push button unit 53 and the push button unit 53 may move inside the through hole: extending from the through hole or pressed into the through hole.

When using the folding knife, press the push button unit 53 to remove the locking edge 51 of the positioning push button 5 out of a notch opening 41 so that the cam 4 can rotate about the recess ring 52. Push the knife body 1 to rotate the cam 4. When reach particular angles, the locking edge 51 of the positioning push button 5 will face a corresponding notch opening 41. Release the push button unit 53, the positioning push button 5 will return to the original position under the force of the reset spring 6 inserting the locking edge 51 in a notch opening 41 of the cam 4, thus preventing the cam 4 from rotating and locking the knife body 1 in position. Using the above operation, the knife body 1 may be locked by different notch openings 41, thus allowing the knife body 1 to have adjustable locking angles. Additionally, user's hands never directly face the knife blade during operation, therefore, avoiding risk of being cut.

EXAMPLE 2

Figure 8:
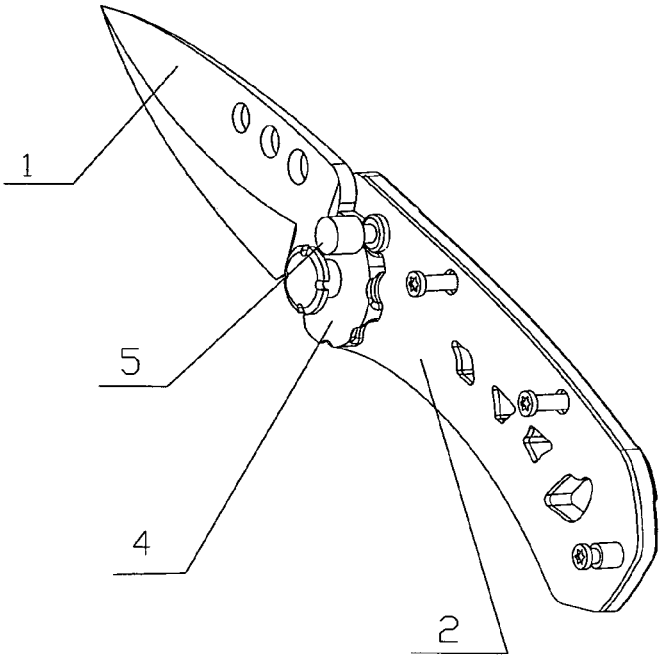
FIG. 8 is a side view of the second structure.

Referring to FIG. 8, the knife body 1 and the cam 4 may be disposed on one side of the knife handle 2, either on the left side or on the right side. Additionally, the positioning push button 5 may be positioned on one side of the knife handle 2, either on the left side or on the right side. This structure is easy to manufacture and intuitive to use.

EXAMPLE 3

Figure 9:
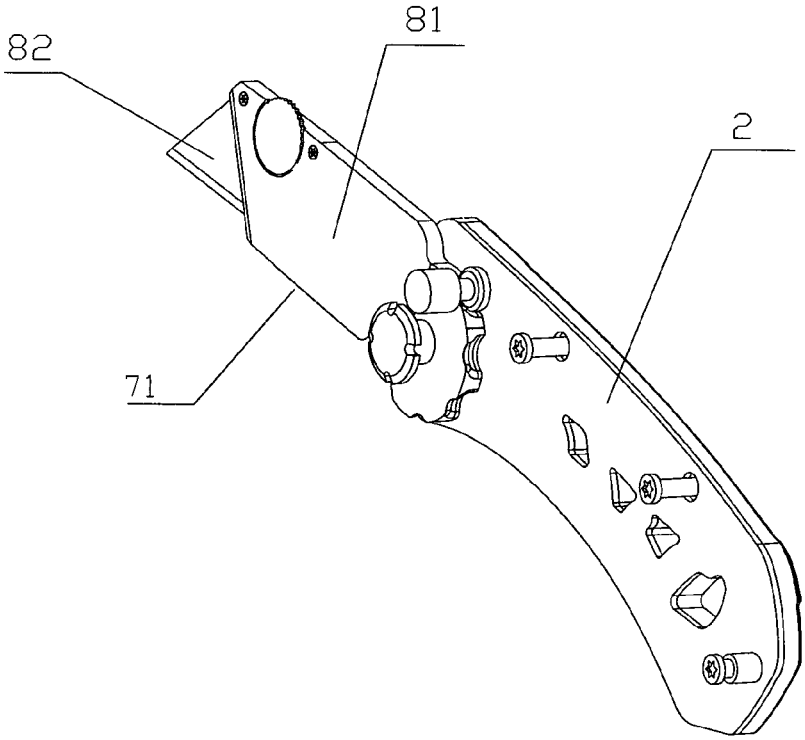
FIG. 9 is a left side view of an embodiment of the present invention with a different knife body.
Figure 10:
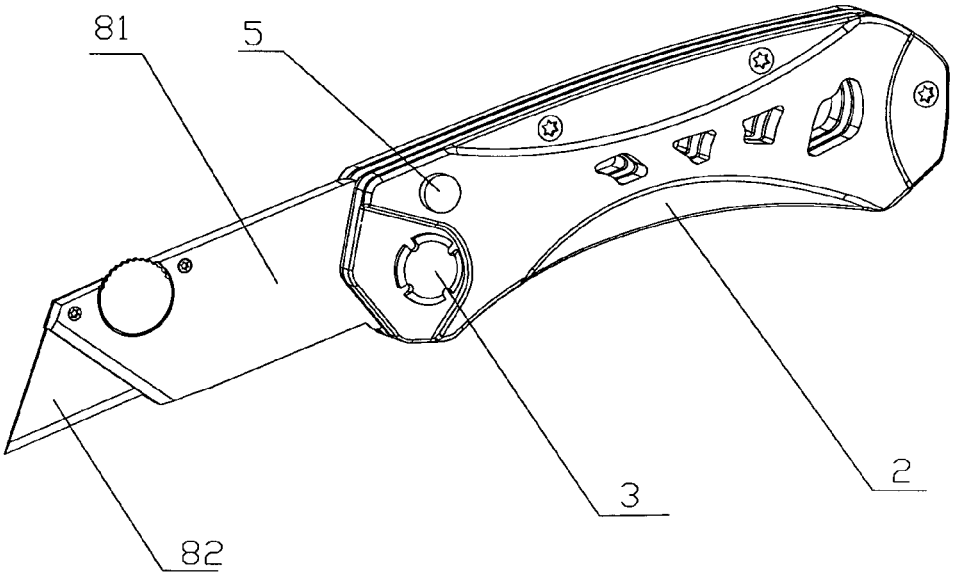
FIG. 10 is a right side view of the embodiment with a different knife body.

FIGS. 8 and 9 illustrate another embodiment of the present invention. In this embodiment, a knife body 71 includes a knife blade 82 and a knife frame 81. The knife blade 82 is mounted on the knife frame 81. The knife body 71 is only example and does not limit the scope of the present invention. In other words, the knife body 71 may have any suitable form.

The above description is aimed to facilitate understanding of the present invention by providing preferred examples. However, the preferred examples do not include all the details, and also do not limit the scope of the present invention. Obviously, many modifications and changes may be made according to the above description. The above embodiments are selected and described to explain the principles and applications of the present invention and to allow persons skilled in the art to fully practice the present invention. The scope of the present invention is only limited by the entire scope of the claims and equivalent thereof.

The invention claimed is:

1. A folding knife having multiple locking angles, comprising:

a knife handle;

a knife body, wherein the knife handle is pivotably coupled to a first end of the knife body;

an angle adjusting mechanism fixedly coupled to the first end of the knife body, wherein the angle adjusting mechanism comprises a plurality of locking structures configured to position the knife body and the knife handle at different angles, each locking structure has at least one notch opening, each notch opening has a first locking edge and a second locking edge, and the first locking edge has a diameter smaller than the second locking edge; and a positioning mechanism configured to select an angle between the knife body and the knife handle, wherein when the knife body and the knife handle is locked at an angle, the positioning mechanism is couple to and lock with the second locking edge of a corresponding notch opening, and a lateral distance moved by the positioning mechanism is related to a radial length of the second locking edge.

2. The folding knife having multiple locking angles of claim 1, wherein the positioning mechanism comprises a push button comprising:

a push button unit;

a locking edge; and a recess ring having one end connected to the push button unit and another end connected to the locking edge, wherein when the push button unit is pressed down, the locking edge moves out of the notch opening to allow the knife body obtain a new angle relative to the knife handle, and when the push button unit is released, the locking edge enters and locks with the second locking edge of the notch openings.

3. The folding knife having multiple locking angles of claim 2, wherein a lateral distance between a position of the push button unit being pressed down and a position of the push button unit being released is slightly larger than a axial length of the second locking edge of the notch opening.

4. The folding knife having multiple locking angles of claim 2, wherein the second locking edge of the notch opening transits to the first locking edge of the notch opening along a smooth curve.

5. The folding knife having multiple locking angles of claim 2, wherein the second locking edge of the notch opening transits to the first locking edge of the notch opening along a line in a shape of steps.

6. The folding knife having multiple locking angles of claim 1, wherein the angle adjusting mechanism comprises a cam, and the plurality of locking structures are distributed along an outer edge of the cam.

7. The folding knife having multiple locking angles of claim 6, wherein the plurality of notch openings are evenly distributed along the outer edge of the cam, and each notch opening is a half cylinder shaped groove.

8. A folding knife having multiple locking angles, wherein the folding knife comprises a knife body and a knife handle, and the knife body is pivotably coupled to the knife handle, characterized in that:

an angle adjusting mechanism disposed on a portion of the knife body connected to the knife handle, wherein the angle adjusting mechanism comprises a plurality of notch openings configured to position the knife body and the knife handle at a plurality of angles, each notch opening has a first locking edge and a second locking edge, and the first locking edge has a diameter smaller than the second locking edge; and a positioning mechanism disposed on the knife handle near a portion connected to the knife body, wherein the positioning mechanism comprises a locking edge configured to couple inside and lock with the notch openings.

9. The folding knife having multiple locking angles of claim 8, wherein the angle adjusting mechanism comprises a cam, and the plurality of notch openings are distributed along an outer edge of the cam.

10. The folding knife having multiple locking angles of claim 9, wherein the plurality of notch openings are evenly distributed along the outer edge of the cam, and each notch opening is a half cylinder shaped groove.

11. The folding knife having multiple locking angles of claim 9, wherein the positioning mechanism comprises a push button comprising:

a push button unit; and a recess ring having one end connected to the push button unit and another end connected to the locking edge, wherein when the push button unit is pressed down, the locking edge moves out of the notch opening to allow the knife body obtain a new angle relative to the knife handle, and when the push button unit is released, the locking edge enters and locks with the second locking edge of the notch openings.

12. A folding knife having multiple locking angles, comprising:

a knife handle;

a knife body, wherein the knife handle is pivotably coupled to a first end of the knife body;

an angle adjusting mechanism fixedly coupled to the first end of the knife body, wherein the angle adjusting mechanism comprises a plurality of notch openings configured to position the knife body and the knife handle at different angles, an inner diameter of each of the notch openings increases from a first locking edge to a second locking edge; and a positioning mechanism configured to select an angle between the knife body and the knife handle, wherein when the knife body and the knife handle is locked at an angle, the positioning mechanism is couple to and lock with one of the plurality of notch openings.

* * * * *

UNITED STATES PATENT AND TRADEMARK OFFICE

CERTIFICATE OF CORRECTION

PATENT NO. : 8,959,779 B2
APPLICATION NO. : 13/516671
DATED : February 24, 2015
INVENTOR(S) : Hao Wen It is certified that error appears in the above-identified patent and that said Letters Patent is hereby corrected as shown below:

Claims:

Column 7, Claim 1, Lines 9-10, please delete "couple to and lock with" and insert --coupled to and locked in-- therefor;

Column 7, Claim 2, Line 23, please delete "relative" and insert --with respect-- therefor;

Column 7, Claim 3, Line 30, please delete "slightly";

Column 8, Claim 11, Line 30, please delete "relative" and insert --with respect-- therefor;

Column 8, Claim 12, Lines 49, please delete "couple to and lock" and insert --coupled to and locked in-- therefor.

Signed and Sealed this
Seventh Day of July, 2015

Michelle K. Lee

Michelle K. Lee
*Director of the United States Patent and Trademark Office*